US006092803A

United States Patent [19]

Munenaka

[11] Patent Number: 6,092,803

[45] **Date of Patent: *Jul. 25, 2000**

[54] SHEET TRANSPORT APPARATUS AND IMAGE FORMING APPARATUS

[75] Inventor: Katsumi Munenaka, Kawasaki, Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/594,669

[22] Filed: Feb. 2, 1996

[30] Foreign Application Priority Data

Feb. 8, 1995 [JP] Japan ..... 7-044844

[51] Int. Cl.[7] ..... B65H 9/04

[52] U.S. Cl. ..... 271/242; 271/270

[58] Field of Search ..... 271/242, 270

[56] References Cited

U.S. PATENT DOCUMENTS

| | | | |
|---|---|---|---|
| 5,260,757 | 11/1993 | Frank et al. | 271/242 X |
| 5,393,044 | 2/1995 | Hagihara et al. | 271/242 X |
| 5,482,265 | 1/1996 | Nakazato et al. | 271/242 |

FOREIGN PATENT DOCUMENTS

| | | | |
|---|---|---|---|
| 127953 | 5/1988 | Japan | 271/270 |
| 69434 | 3/1989 | Japan | 271/270 |
| 172144 | 7/1989 | Japan | 271/242 |
| 85244 | 3/1992 | Japan | 271/242 |
| 319615 | 12/1993 | Japan | 271/270 |
| 24588 | 2/1994 | Japan | 271/242 |
| 72585 | 3/1994 | Japan | 271/270 |
| 127753 | 5/1994 | Japan | 271/242 |

*Primary Examiner*—Boris Milef
*Assistant Examiner*—Patrick Mackey
*Attorney, Agent, or Firm*—Fitzpatrick, Cella, Harper & Scinto

[57] ABSTRACT

The impact sound when a sheet member forms a loop is reduced so as to make the apparatus less noisy. A speed control device is provided for making the transport speed when the sheet member is made to hit a first transport device by a second transport device relatively slower than that of the first transport device. By changing the amount of transport of the first transport device along the width of the sheet member at right angles to the transport direction of the sheet member, the loop is formed successively along the width of the sheet member.

16 Claims, 15 Drawing Sheets

| FIG. 5A |
| --- |
| FIG. 5B |

| FIG. 12A |
| --- |
| FIG. 12B |

SHEET TRANSPORT APPARATUS AND IMAGE FORMING APPARATUS

BACKGROUND OF THE INVENTION

1. Field of the Invention

The present invention relates to a sheet member transport apparatus for transporting a sheet member with the skew of the sheet member being compensated by making the sheet member hit a registration mechanism and form a loop, and relates to an image forming apparatus using the sheet member transport apparatus.

2. Description of the Related Art

In a sheet member transport apparatus which has hitherto been used in an electrophotographic copying machine or the like, in the case of, for example, cassette paper, sheet members loaded in a paper supply cassette are supplied one by one, and fed into an image forming unit while being timed by a register roller.

For a sheet member to be fed into the image forming unit with the sheet member being accurately registered, the top edge of the sheet member is made to hit a register roller at rest, and fed excessively, and thus a loop is formed within a sheet member transport passage. After the sheet member is sufficiently registered and compensated, the register roller starts to rotate. The above construction is common.

Since the loop is set to be large in order to absorb variations of the operating time of a clutch for controlling the rotation of the roller for pushing in the sheet member, the sheet member buckles to a complex shape, and forms a loop within the sheet member transport passage.

However, in the above-described prior art, since the sheet member transport speed is usually set at the same speed as the image forming speed, the sheet member hits the register roller and buckles, and when a loop is formed, the generation of an impact sound of a pop is conspicuous. For creating a pleasant office environment, there has been demands for office machines to be less noisy. If the transport speed of the sheet member is set to be slow, the impact sound can be reduced; however, the throughput (the number of sheets printed per unit time) of the sheet member is decreased.

In Blueangel in Germany, the noise standards measurement mode is changed from the FAST mode to the IMPULSE mode, and the weight of restriction has shifted from normal sound to impact sound. Therefore, making the impact sound less noisy has become a particularly important technological problem.

SUMMARY OF THE INVENTION

The present invention has been are achieved to solve the above-described problems of the prior art. It is an object of the present invention to reduce an impact sound produced when a loop is formed by making the sheet member transport speed relatively slow when the sheet member forms the loop is formed anteriorly to first transport means and to contribute to reduced noise of the apparatus.

It is another object of the present invention to reduce the impact sound generated when a loop is formed and to contribute to reduced noise of the apparatus by preventing that a loop is formed at a stroke along the width of the sheet member at right angles to the transport direction of the sheet member when the loop of the sheet member is formed anteriorly to the register roller.

To achieve the above-described objects, according to one aspect of the present invention, there is provided a sheet member transport apparatus for transporting a sheet member with the skew of the sheet member being compensated by making the end portion of a sheet member hit first transport means at rest by means of second transport means and making the sheet member form a loop, the sheet member transport apparatus being provided with speed control means for making the transport speed of the sheet member when the sheet member is made to hit the first transport means relatively slower than that of the sheet member transported by the first transport means.

According to another aspect of the present invention, there is provided a sheet member transport apparatus, wherein the speed control means controls the rotational speed of a motor of the second transport means.

According to a further aspect of the present invention, there is provided a sheet member transport apparatus, wherein the motor is a motor which is dedicated to the second transport means, and which is drivingly controlled independently of at least the motor for driving the first transport means.

According to a still further aspect of the present invention, there is provided a sheet member transport apparatus for transporting a sheet member with the skew of the sheet member being compensated by making the end portion of a sheet member hit first transport means at rest by means of second transport means and making the sheet member form a loop, wherein the transport speed of the second transport means is set to be slower than that of the first transport means, and a one-way clutch is provided in the middle of a driving transmission passage to the second transport means.

According to a still further aspect of the present invention, there is provided a sheet member transport apparatus for transporting a sheet member with the skew of the sheet member being compensated by making the end portion of a sheet member hit first transport means at rest by means of second transport means and making the sheet member form a loop, wherein a torque limiter and braking means for braking the second transport means are provided in the middle of a driving transmission passage to the second transport means.

According to a still further aspect of the present invention, there is provided a sheet member transport apparatus for transporting a sheet member with the skew of the sheet member being compensated by making the end portion of a sheet member hit first transport means at rest by means of second transport means and making the sheet member form a loop, wherein, by varying the amount of transport of the first transport means along the width of the sheet member at right angles to the transport direction of the sheet member, a loop is formed in succession along the width of the sheet member.

According to a still further aspect of the present invention, there is provided a sheet member transport apparatus, wherein two second transport means are provided independently of each other at both end portions along the width of the sheet member at right angles to the transport direction of the sheet member, and control is effected in such a way that a loop is begun to be formed from the end of one side of the sheet member, the loop is successively formed toward the other end, and finally the loop is formed in the entire area along the width of the sheet member.

According to a still further aspect of the present invention, there is provided an image forming apparatus in which the sheet member transport apparatus is used in a transport passage of a sheet member to be fed into the image forming unit.

In accordance with the first aspect of the present invention, since the transport speed by the second transport means when a sheet member is made to hit first transport means and forms a loop is made to be relatively slower than the transport speed of the first transport means, the loop is gradually formed, and a small impact sound is generated. Also, since the transport speed is made to be slower only when the sheet member is made to hit the first transport means, the time required for transportation does not become meaninglessly long.

In accordance with the second aspect of the present invention, if the transport speed is controlled by the rotational speed of the motor, the construction of the apparatus is simplified.

In accordance with the third aspect of the present invention, when a dedicated motor of the second transport means is used, the second transport means for making the sheet member form a loop is driven usually at the same speed as that of the first transport means, and when the sheet member is made to hit the first transport means and a loop is formed, the sheet member transport speed is made to be slow. Therefore, the loop is gradually formed, and a small impact sound is generated.

In accordance with the fourth aspect of the present invention, since a loop is formed at the sheet member transport speed by the second transport means for forming a loop, which is slower than that of the first transport means, the loop is gradually formed, and a small impact sound is generated.

After the loop is formed, the first transport means starts driving. However, since the transport speed by the first transport means is faster, the loop disappears, and the second transport means for making the sheet member form a loop is in such a state as being pulled by the sheet member transported by the first transport means. At this time, since a one-way clutch is provided in the middle of a driving transmission passage, the one-way clutch slips, and there is no problem with the fact that the transport speed by the second transport means is slow.

In accordance with the fifth aspect of the present invention, since the second transport means is made to decrease its speed by braking means when the sheet member forms a loop, the loop is gradually formed, and a small impact sound is generated. Since, when the second transport means is braked by the braking means, a torque limiter slips at a fixed rate, the transport speed of the second transport means is decreased. After the loop is formed, the braking means is released, and the transport speed of the second transport means is returned to the same transport speed as that of the first transport means.

In accordance with the sixth aspect of the present invention, since the loop is formed from one side of the sheet member toward the other side along the width of the sheet member at right angles to the transport direction of the sheet member without making the sheet member form the loop at a stroke, the impact sound when the loop is formed is small.

In accordance with the seventh aspect of the present invention, two second transport means are controlled independently of each other, the sheet member begins to form a loop from one side of the sheet member along the width thereof and forms a loop successively toward the other end, and finally the loop is formed in the entire area along the width of the sheet member; therefore, the impact sound when the loop is formed is small.

If the sheet member transport apparatus of the present invention is applied in a sheet member transportation passage to an image forming unit of an image forming apparatus, it is possible to make the image forming apparatus less noisy.

The above and further objects, aspects and novel features of the invention will becomes more apparent from the following detailed description when read in connection with the accompanying drawings.

DETAILED DESCRIPTION OF THE PREFERRED EMBODIMENTS

[First Embodiment]

Figure 1:
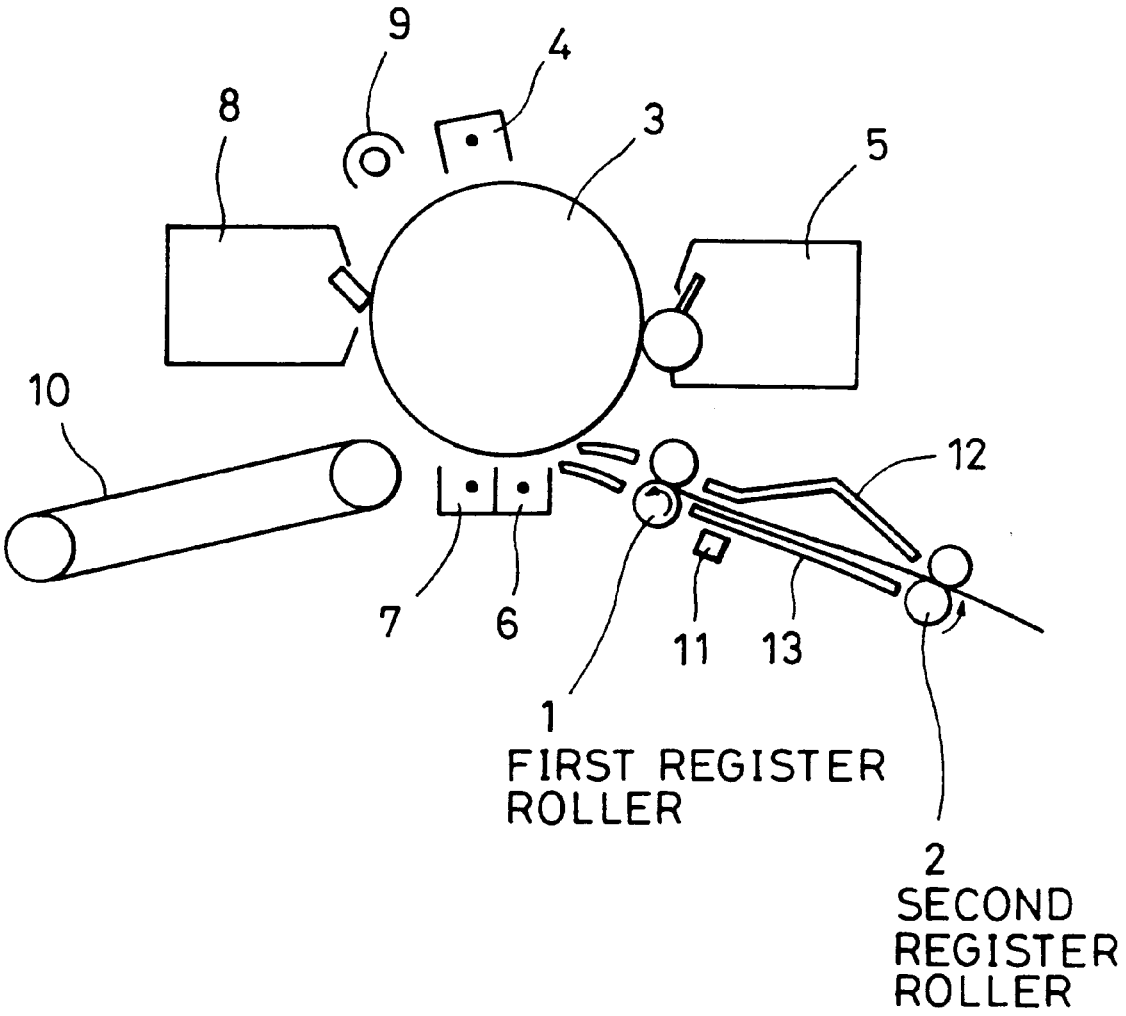
FIG. 1 is a sectional view of the essential portion of an electrophotographic copying machine in accordance with a first embodiment of the present invention.

FIG. 1 is a sectional view of the essential portion of a first embodiment in which a sheet member transport apparatus of the present invention is applied to an electrophotographic copying machine serving as an image forming apparatus.

Referring to FIG. 1, reference numeral 1 denotes first transport means, such as a first register roller, for registering a sheet member. Reference numeral 2 denotes second transport means, such as a second register roller, which is positioned upstream of the first register roller 1.

Reference numeral 3 denotes a photosensitive drum serving as an image carrier. Reference numeral 4 denotes a primary charger for uniformly charging the photosensitive drum. Reference numeral 5 denotes a developing unit for making an electrostatic latent image formed on the photosensitive drum visible by toner. Reference numeral 6 denotes a transfer charger for transferring a toner image on the photosensitive drum 3 to a sheet member. Reference numeral 7 denotes a separation charger for separating the sheet member from the photosensitive drum 3. Reference numeral 8 denotes a cleaner for cleaning toner remaining on the photosensitive drum 3. Reference numeral 9 denotes an electric-charge removing lamp 9 for removing electric charge remaining on the photosensitive drum 3. Reference numeral 10 denotes a transport belt for transporting a sheet member onto which a toner image has been transferred to a fixing unit (not shown) in the downstream.

When the electrophotographic copying machine receives an image formation command, sheet members are fed one by one from a cassette (not shown) in which sheet members are housed.

The fed sheet member reaches the second register roller 2 and is further transported, and the top edge of the sheet member is detected by a detection sensor 11, after which the sheet member hits the nip of the first register roller 1 which is at rest and on standby. Further, the second register roller 2, after the detection sensor 11 detects the top edge of the sheet member, continues to rotate for a predetermined time, buckles in the space surrounded between an upper guide plate 12 and a lower guide plate 13, and forms a loop. Being pushed in the nip of the first register roller 1, the top edge of the sheet member is registered and compensated at strictly right angles (in the direction of the nip) to the direction of the movement of the sheet member.

Figure 2:
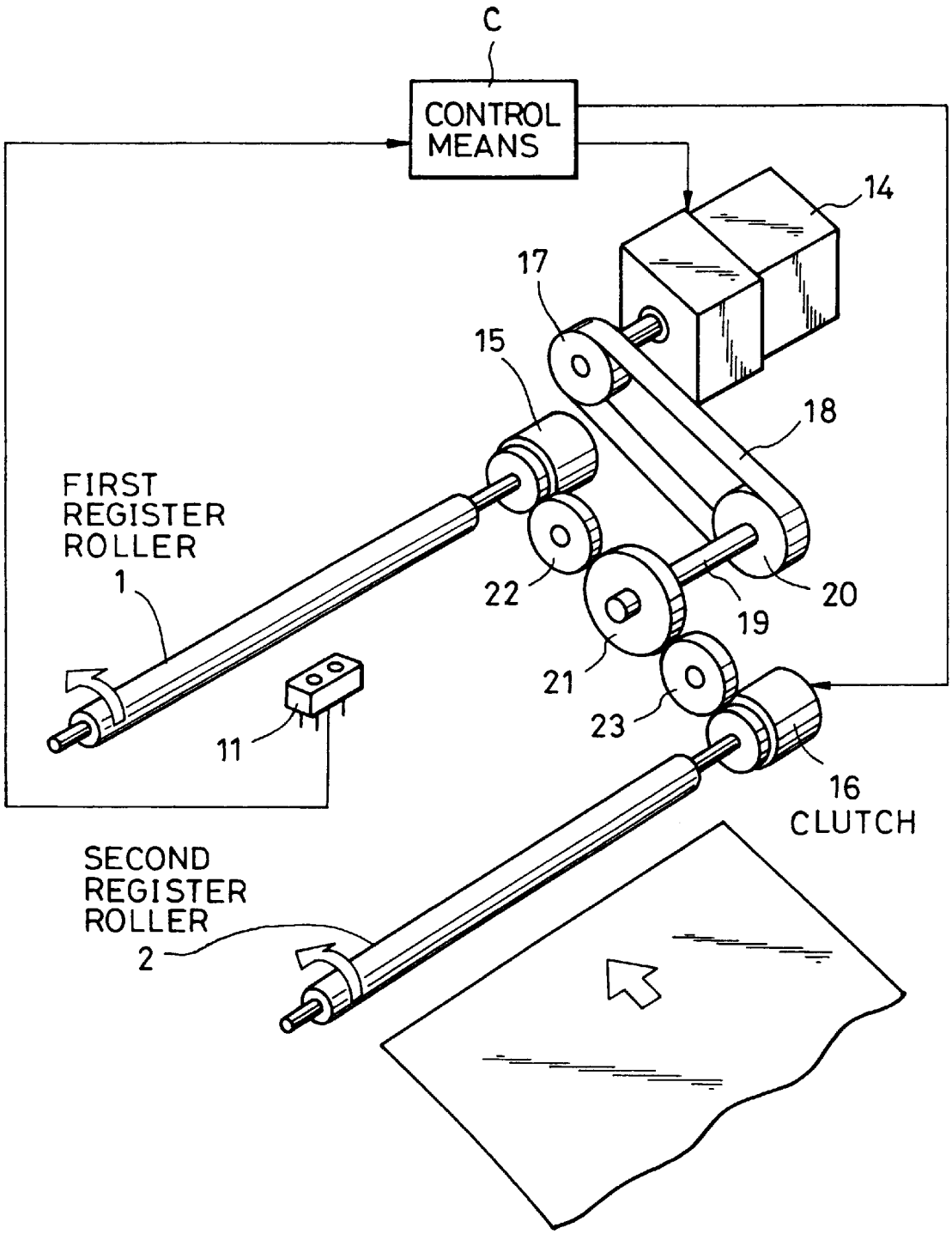
FIG. 2 is a perspective view of the essential portion in accordance with the first embodiment of the present invention.

FIG. 2 is a perspective view of the essential portion illustrating driving means of the first register roller 1 and the second register roller 2.

The first register roller 1 and the second register roller 2 are coupled to one motor 14 capable of changing its rotational speed through a drive transmission system. Rotation driving is transmitted via clutches 15 and 16, respectively.

Referring to FIG. 2, reference numeral 17 denotes a timing pulley mounted on the output shaft of the motor 14. Reference numeral 18 denotes a timing belt. Reference numeral 19 denotes a terminal shaft. Reference numeral 20 denotes a timing pulley mounted in one end of the terminal shaft 19. Reference numeral 21 denotes a gear mounted in the other end of the terminal shaft 19. Reference numerals 22 and 23 denote idler gears.

The motor 14 has an encoder mounted therein, and is controlled at three stages of high speed H, low speed L, and stop by a control board C which constitutes control means.

When the motor 14 is driven at high speed H, the first register roller 1 and the second register roller 2 are driven so as to transport the sheet member at the same speed V as the speed at which an image is formed by the electrophotographic copying machine, i.e., a process speed (P.S.). The process speed is equal to the peripheral speed of the photosensitive drum 3.

When the motor 14 is driven at low speed L, with only the clutch 16 turned on, the second register roller 2 is driven to transport the sheet member at a speed v slower than the process speed. This speed v is a speed during the time from when the top edge of the sheet member hits the first register roller 1 until a loop is formed, which speed is preset so that the impact sound at the moment the loop is formed is small.

Figure 3:
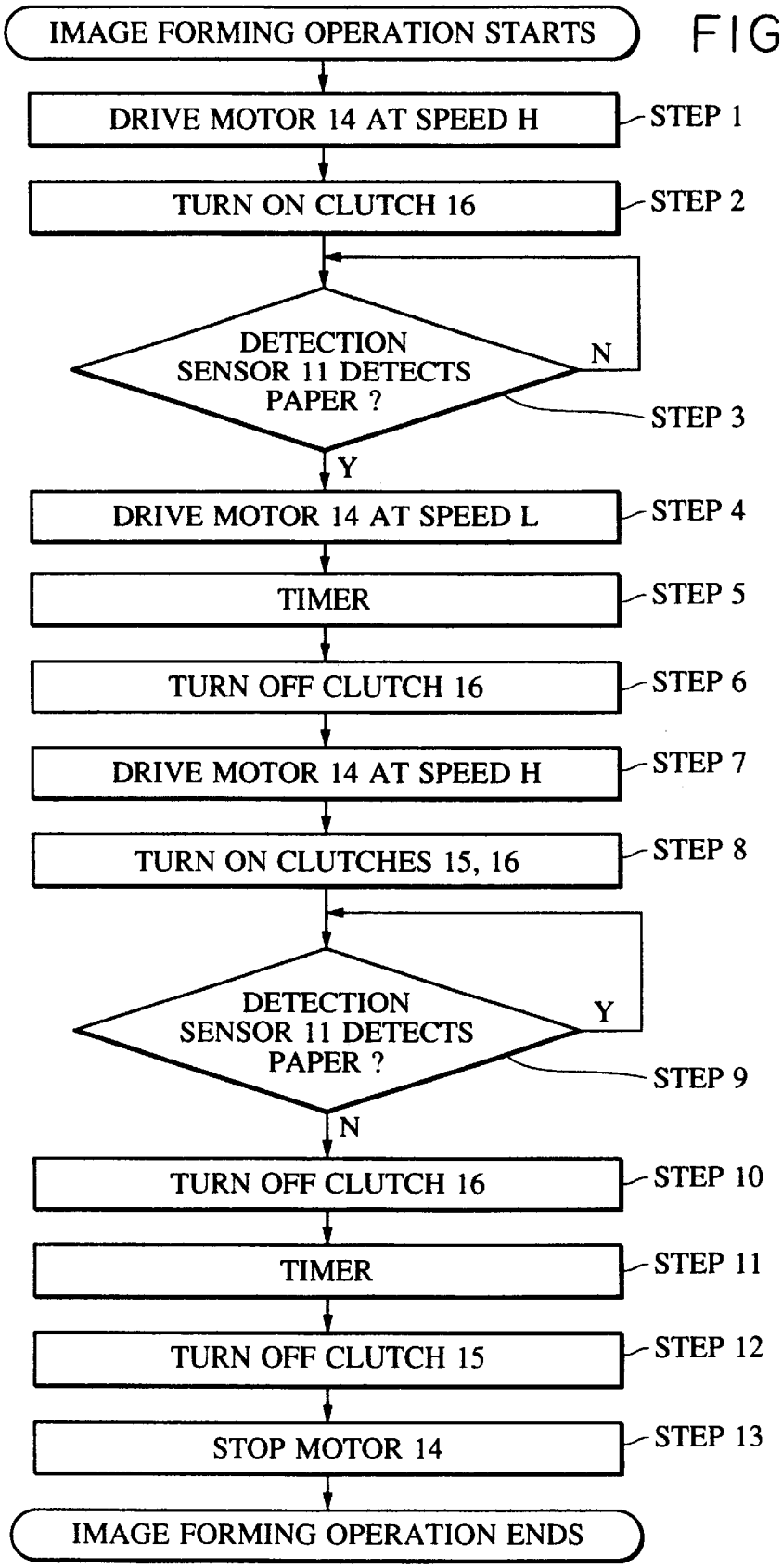
FIG. 3 is a flowchart illustrating control in accordance with the first embodiment of the present invention.

FIG. 3 is a flowchart illustrating speed control of the motor 14 and on/off control of the clutches 15 and 16.

After the electrophotographic copying machine receives the image formation command, the motor 14 is driven at the normal speed H (step 1). Then, the clutch 16 is turned on, and the second register roller 2 starts to rotate to transport the sheet member at speed V (step 2).

The sheet member which is fed one by one from the paper supply cassette reaches the second register roller 2, is transported at speed V, and the top edge thereof is detected by the detection sensor 11 (step 3). Thereupon, the motor 14 is changed to be driven at speed L (step 4). The sheet member is transported at speed v and hits the nip of the first register roller 1, and the sheet member is continued to be transported at speed v by the second register roller 2 and begins to form a loop.

After a predetermined time has elapsed which is necessary from when the top edge of the sheet member is detected by the detection sensor 11 until the sheet member forms a sufficient loop (step 5), the clutch 16 is turned off, and the rotation of the second register roller 2 is stopped (step 6). Thereupon, the motor 14 is returned to be driven at speed H again (step 7).

The clutches 15 and 16 are turned on in synchronization with the toner image formed on the photosensitive drum 3, the sheet member is transported again at speed V, the toner image is transferred onto the sheet member, and the image formation proceeds (step 8).

Thereafter, when the detection sensor 11 no longer detects the sheet member, that is, after the bottom edge of the sheet member passes the detection sensor 11 (step 9), the clutch 16 is turned off, and the rotation of the second register roller 2 is stopped (step 10). When a time has elapsed which is necessary from when the bottom edge of the sheet member passes the detection sensor 11 until the bottom edge of the sheet member passes the first register roller 1 (step 11), the clutch 15 is turned off, and the rotation of the first register roller 1 is stopped (step 12). Then, the motor 14 is stopped (step 13), and the image forming operation terminates.

[Second Embodiment]

Figure 4:
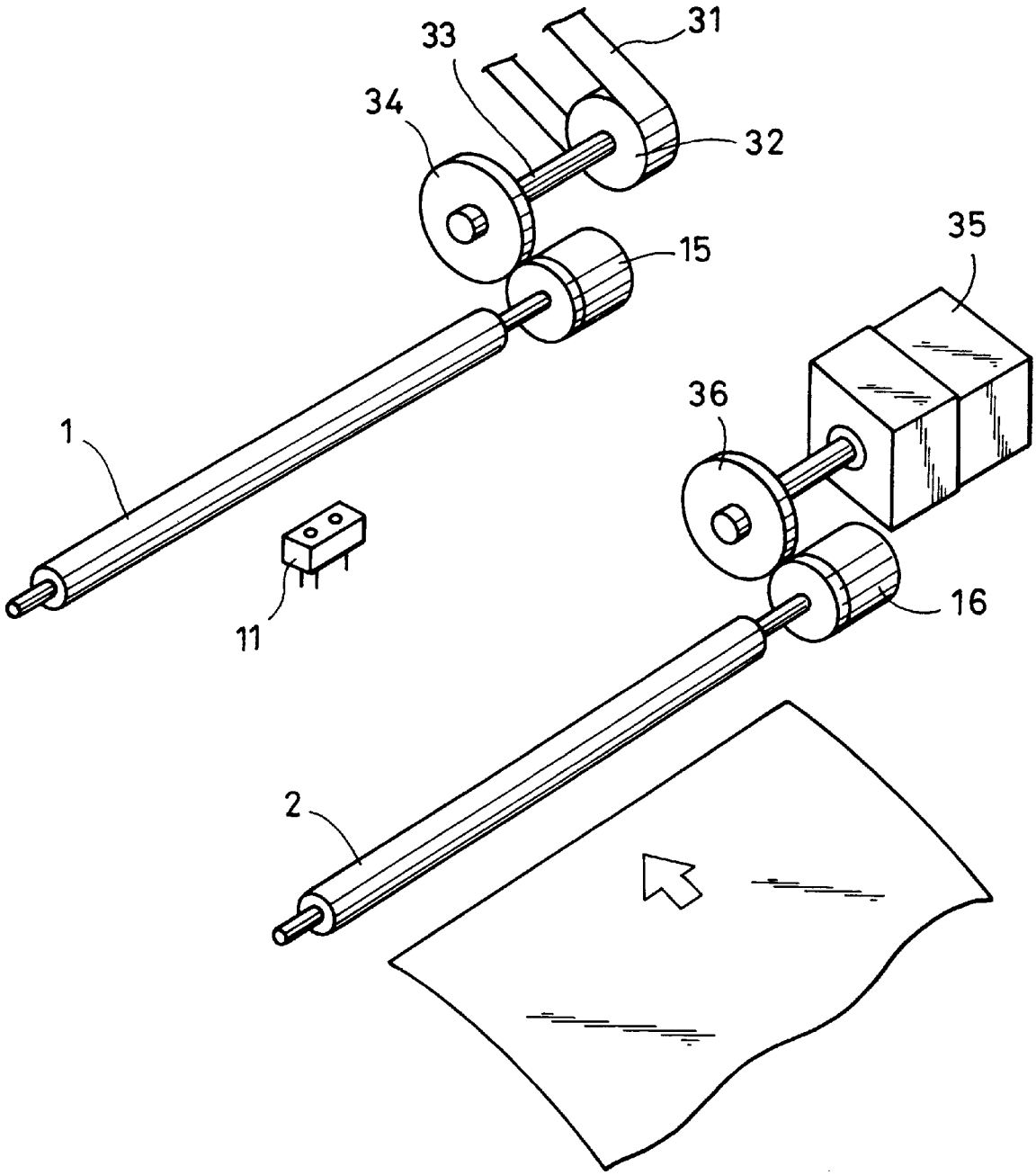
FIG. 4 is a perspective view of the essential portion in accordance with a second embodiment of the present invention.

FIG. 4 is a perspective view of the essential portion illustrating first and second register rollers in which the present invention is applied to an electrophotographic copying machine.

Since the construction of the essential portion of the image formation inside the electrophotographic copying machine in the second embodiment is the same as that described in the first embodiment, an explanation thereof is omitted.

Referring to FIG. 4, the first register roller 1 is connected from a main motor (not shown) for driving the photosensitive drum 3 of the electrophotographic copying machine or the like through a drive train, and rotation driving is transmitted to the first register roller 1.

Reference numeral 31 denotes a timing belt which receives driving from the main motor. Reference numeral 32 denotes a timing pulley which meshes with the timing belt 31. Reference numeral 33 denotes a terminal shaft. Reference numeral 34 denotes a gear which is mounted in the other end of the terminal shaft 33 and meshes with the gear of the clutch 15. When the main motor is being driven and the clutch 15 is turned on, the first register roller 1 is driven to transport the sheet member at the process speed V which is equal to the peripheral speed of the photosensitive drum 3 described in the first embodiment.

The second register roller 2 is connected through a drive train from a motor 35 capable of changing its rotational speed, which motor is controlled independently of the drive source of another sheet member transport means, such as the first register roller 1. Reference numeral 36 denotes a gear which is mounted in the output shaft of the motor 35 and meshes with the gear of the clutch 16 provided on the shaft of the second register roller 2.

The motor 35 has an encoder mounted therein, and is controlled at three stages of high speed H, low speed L, and stop by a control board (not shown).

When the motor 35 is driven at high speed H and the clutch 16 is turned on, the second register roller 2 is driven so as to transport the sheet member at the process speed V.

When the motor 35 is driven at low speed L and the clutch 16 is turned on, the second register roller 2 is driven to transport the sheet member at a preset process speed v so that the impact sound when the sheet member forms a loop is small.

Figure 5A:
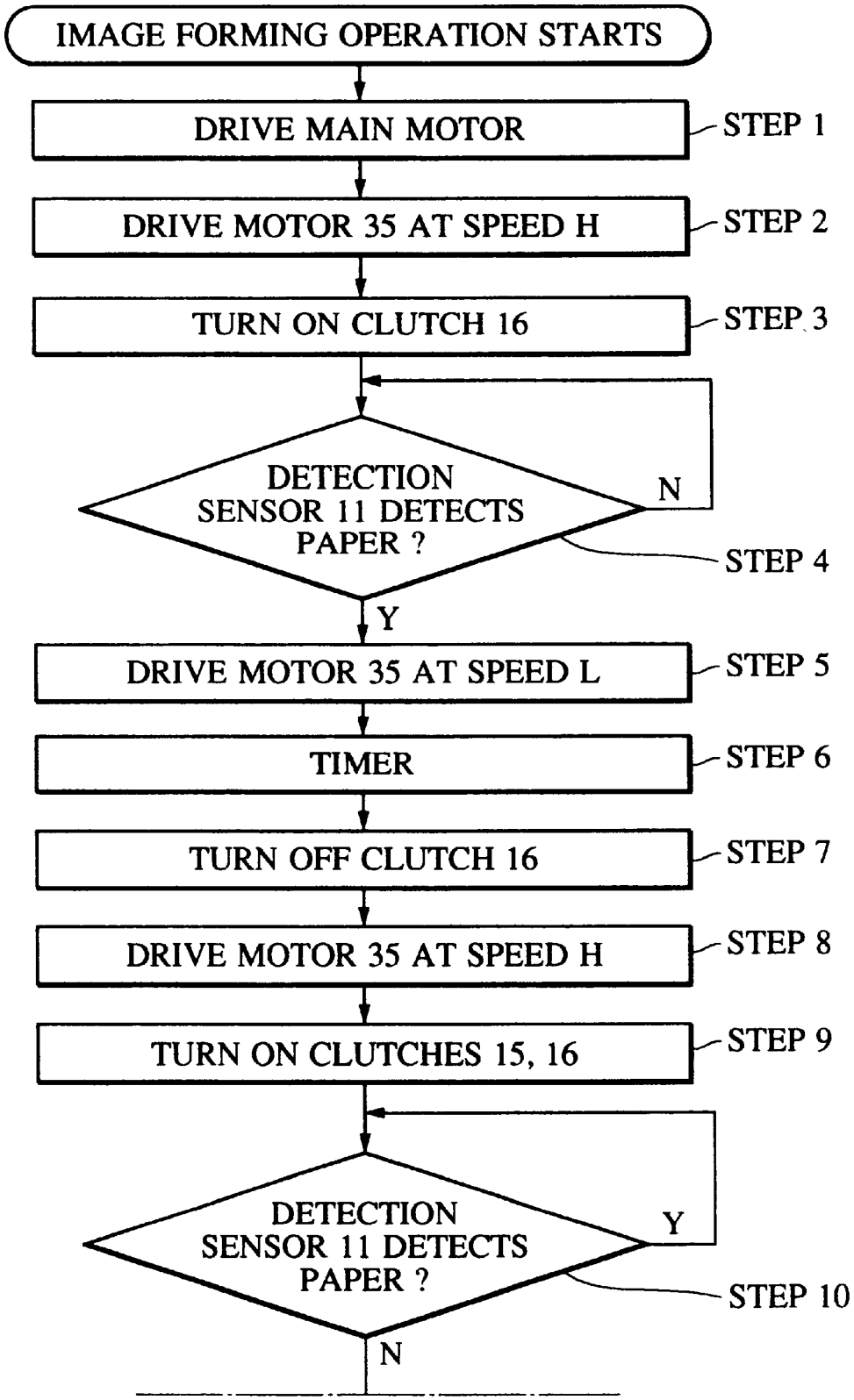
FIGS. 5, 5(A) and 5(B) are flowcharts illustrating control in accordance with the second embodiment of the present invention.
Figures 5, 5B:
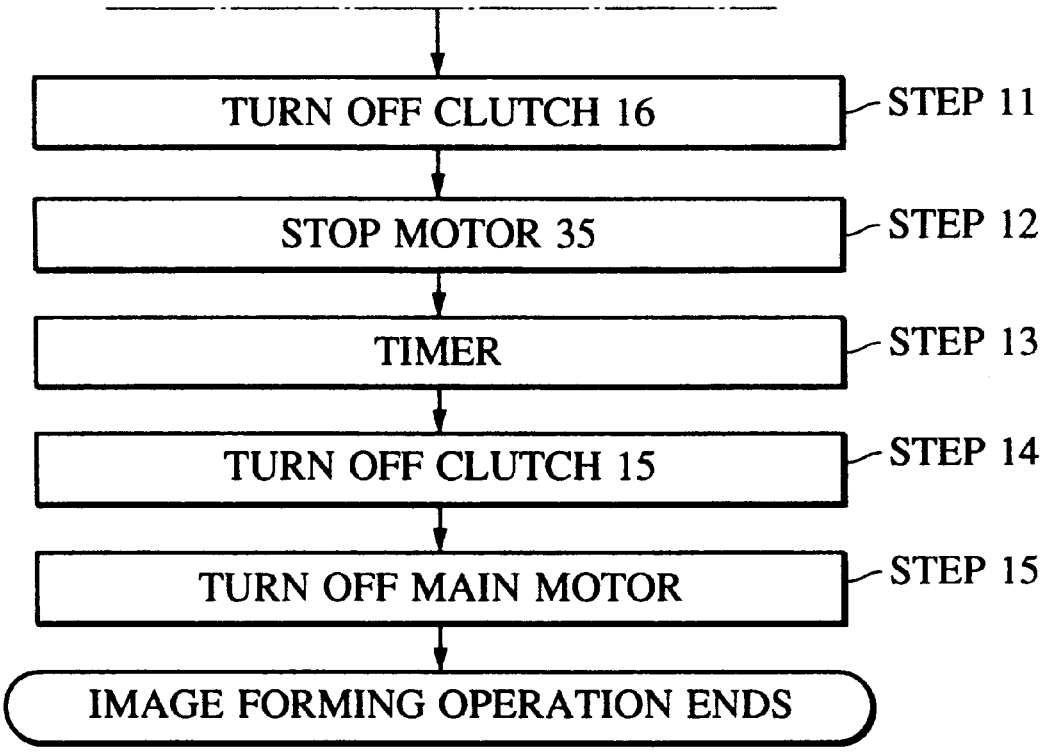

FIG. 5 is a flowchart illustrating speed control of the main motor and the motor 35, and on/off control of the clutches 15 and 16. After the electrophotographic copying machine receives an image formation command, the main motor is driven (step 1), and the motor 35 is driven at speed H (step 2). Then, the clutch 16 is turned on, and the second register roller 2 starts to rotate to transport the sheet member at speed V (step 3).

The sheet member which is fed one by one from the paper supply cassette reaches the second register roller 2 and is transported at speed V, and the top edge of the sheet member is detected by the detection sensor 11 (step 4). Thereupon, the motor 35 is changed to be driven at speed L (step 5). The transport speed of the sheet member is decreased from V to v before the sheet member reaches the first register roller 1. The sheet member hits the nip of the first register roller 1 and is continued to be transported at speed v by the second register roller 2, and begins to form a loop.

After a predetermined time has elapsed which is necessary from when the top edge of the sheet member is detected by the detection sensor 11 until the sheet member forms a sufficient loop (step 6), the clutch 16 is turned off, and the rotation of the second register roller 2 is stopped (step 7). Thereupon, the motor 35 is returned to be driven at speed H again (step 8).

The clutches 15 and 16 are turned on in synchronization with the toner image formed on the photosensitive drum 3, the sheet member is transported again at speed V, the toner image is transferred onto the sheet member, and the image formation proceeds (step 9).

Thereafter, when the detection sensor 11 no longer detects the sheet member, that is, after the bottom edge of the sheet member passes the detection sensor 11 (step 10), the clutch 16 is turned off, and the rotation of the second register roller 2 is stopped (step 11). Then, the driving of the motor 35 is stopped (step 12).

When a time has elapsed which is necessary from when the bottom edge of the sheet member passes the detection sensor 11 until the bottom edge of the sheet member passes the first register roller 1 (step 13), the clutch 15 is turned off, and the rotation of the first register roller 1 is stopped (step 14). Then, the main motor is stopped (step 15), and the image forming operation terminates.

[Third Embodiment]

Figure 6:
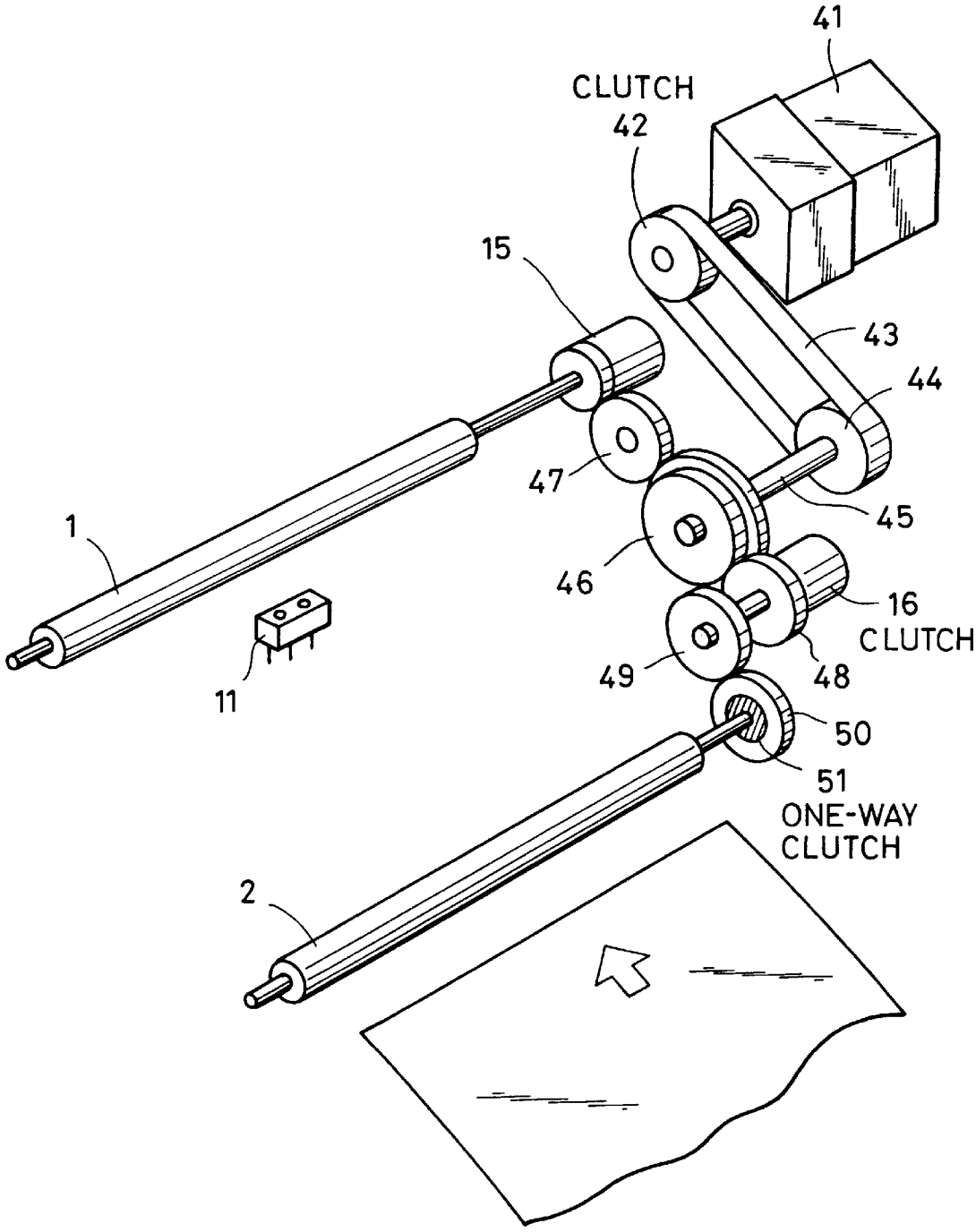
FIG. 6 is a perspective view of the essential portion in accordance with a third embodiment of the present invention.

FIG. 6 is a perspective view of the essential portion illustrating driving means of first and second register rollers in which the present invention is applied to an electrophotographic copying machine.

Since the construction of the essential portion of the image formation inside the electrophotographic copying machine in the third embodiment is the same as that described in the first embodiment, an explanation thereof is omitted.

Referring to FIG. 6, the first register roller 1 and the second register roller 2 are connected from the motor 41 through a drive train, and rotation driving is transmitted via the clutches 15 and 16, respectively.

Reference numeral 42 denotes a timing pulley mounted in the output shaft of the motor 41. Reference numeral 43 denotes a timing belt. Reference numeral 44 denotes a timing pulley. Reference numeral 45 denotes a terminal shaft on which the timing pulley 44 is securedly provided.

A step gear 46 made of small and large two gears is securedly provided in the other end of the terminal shaft 45.

Reference numeral 47 denotes an idler gear which meshes with the large gear of the step gear 46 and the gear of the clutch 15, and transmits driving.

Reference numeral 48 denotes a gear of the clutch 16, which meshes with the small gear of the step gear 46. A gear 50 provided in the end portion of the second register roller 2 meshes with a gear 49 which is securedly provided in the shaft end of the clutch 16. The gear 50 is mounted on the shaft of the second register roller 2 via a one-way clutch 51.

The one-way clutch 51 locks in a direction in which the gear 50 causes the second register roller 2 to be driven to transport the sheet member. In the reverse rotation, the one-way clutch 51 is able to idle with an extremely small torque.

The motor 41 is controlled at a fixed rotational speed. When the clutch 15 is turned on, the first register roller 1 is driven so as to transport the sheet member at the process speed L. When the clutch 16 is turned on, the second register roller 2 is driven so as to transport the sheet member at speed v slower than the process speed V. The speed v is preset so that the impact sound when the sheet member forms a loop is small.

Figure 7:
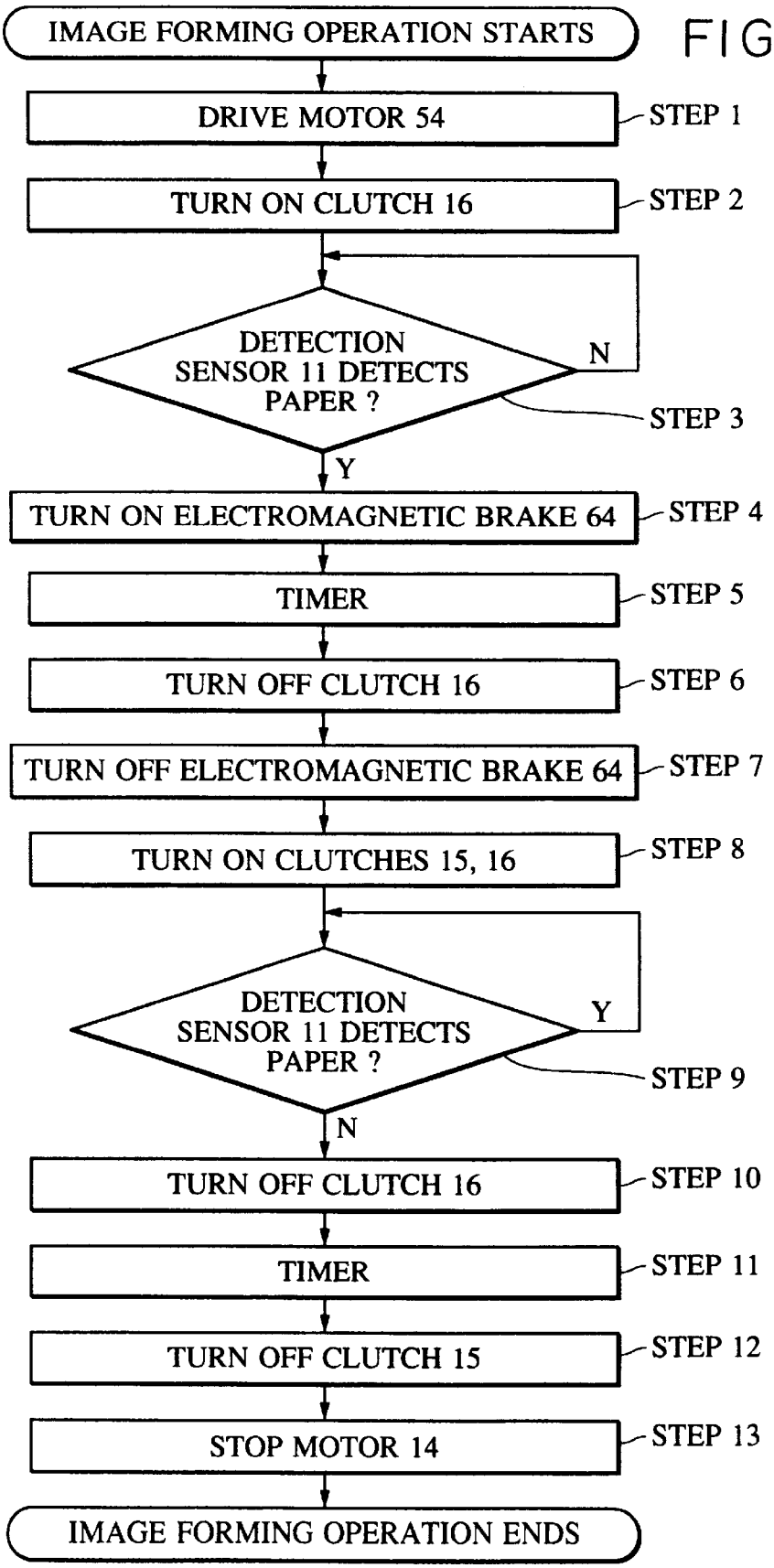
FIG. 7 is a flowchart illustrating control in accordance with the third embodiment of the present invention.

FIG. 7 is a flowchart illustrating speed control of the motor 41 and on/off control of the clutches 15 and 16.

After the electrophotographic copying machine receives an image formation command, the motor 41 is driven at a fixed speed (step 1). Then, the clutch 16 is turned on, and the second register roller 2 starts to rotate to transport the sheet member at speed v (step 2). From when the sheet member which is fed one by one from the paper supply cassette reaches the second register roller 2, the sheet member is transported at speed v, and the top edge of the sheet member is detected by the detection sensor 11 (step 3).

The sheet member hits the nip of the first register roller 1 and is continued to be transported at speed v by the second register roller 2, and begins to form a loop. After a predetermined time has elapsed which is necessary from when the top edge of the sheet member is detected by the detection sensor 11 until the sheet member forms a sufficient loop (step 4), the clutch 16 is turned off, and the rotation of the second register roller 2 is stopped (step 5). The clutches 15 and 16 are turned on in synchronization with the toner image formed on the photosensitive drum 3 (step 6). The first register roller 1 begins to transport the sheet member at speed V, and the second register roller 2 begins to transport the sheet member at speed v. Since there is a difference between speeds V and v, the formed loop becomes gradually small. In the sheet member of a size which is longer along the transport direction, the loop disappears completely while the second register roller 2 transports the sheet member.

After the loop has disappeared, the second register roller 2 is rotated following the movement of the sheet member while the one-way clutch 51 idles in such a state that the sheet member is pulled by the sheet member transported by the first register roller 1.

Thereafter, when the detection sensor 11 no longer detects the sheet member, that is, after the bottom edge of the sheet member passes the detection sensor 11 (step 7), the clutch 16 is turned off, and the rotation of the second register roller 2 is stopped (step 8). When a time has elapsed which is necessary from when the bottom edge of the sheet member passes the detection sensor 11 until the bottom edge of the sheet member passes the first register roller 1 (step 9), the clutch 15 is turned off, and the rotation of the first register roller 1 is stopped (step 10). Then, the motor 41 is stopped (step 11), and the image forming operation terminates.

In this embodiment, the clutch 16 for turning on/off the driving of the second register roller 2 is disposed between the step gears 46 and 50 as shown in FIG. 6, and the one-way clutch 51 is disposed between the gear 50 and the second register roller 2. However, if an electromagnetic clutch having a very small idling torque during off time is used for the clutch 16, the one-way clutch 51 is not always necessary.

Figure 8:
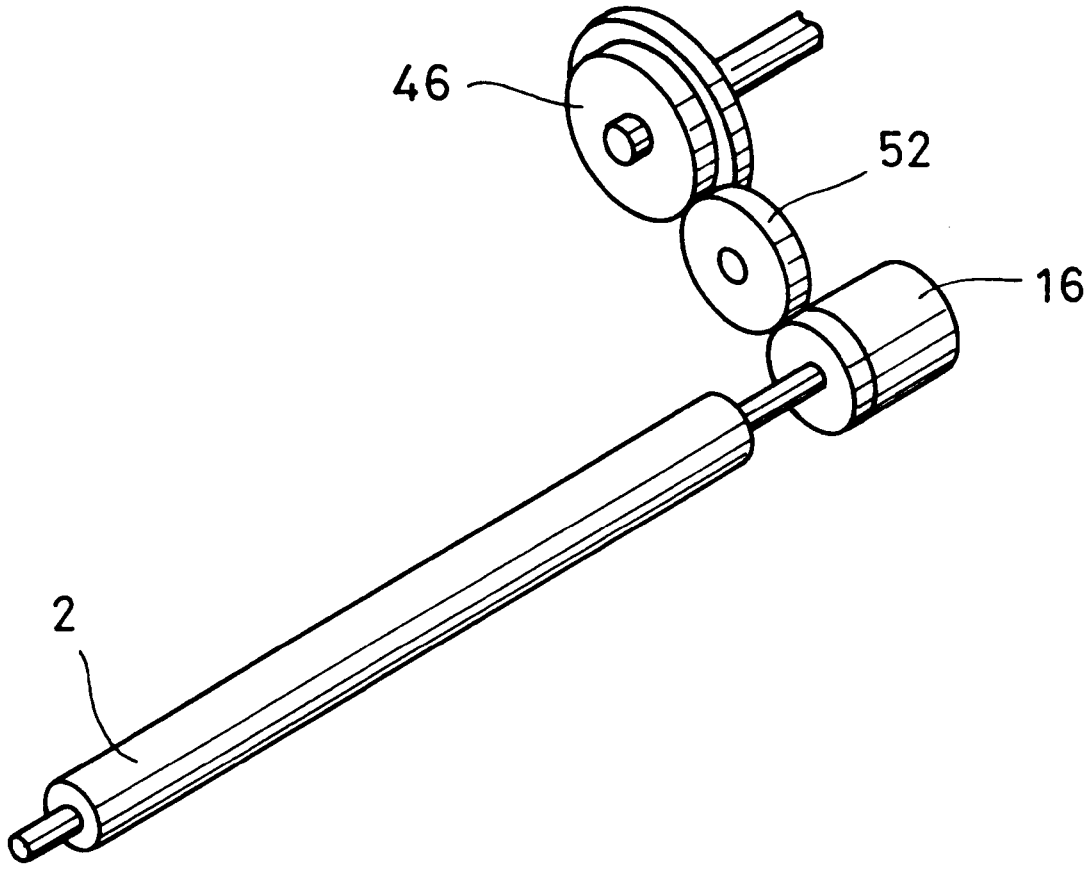
FIG. 8 is a perspective view of the essential portion in accordance with the third embodiment of the present invention.

FIG. 8 is a perspective view of the essential portion in this embodiment. The clutch 16 is provided on the second register roller 2, and is connected to the small gear of the two-step gear 46 through an idler gear 52.

Unlike the above-described case in which the clutches 15 and 16 are turned on in step 6, only the clutch 15 is turned on, and the clutch 16 is kept turned off. The sheet member begins to be transported at speed V by the first register roller 1, but the second register roller 2 does not transport the sheet member; therefore, the formed loop disappears instantly. Since the idling torque of the clutch 16 during the off time is extremely small, the second register roller 2 is able to idle following the sheet member transported by the first register roller 1.

[Fourth Embodiment]

Figure 9:
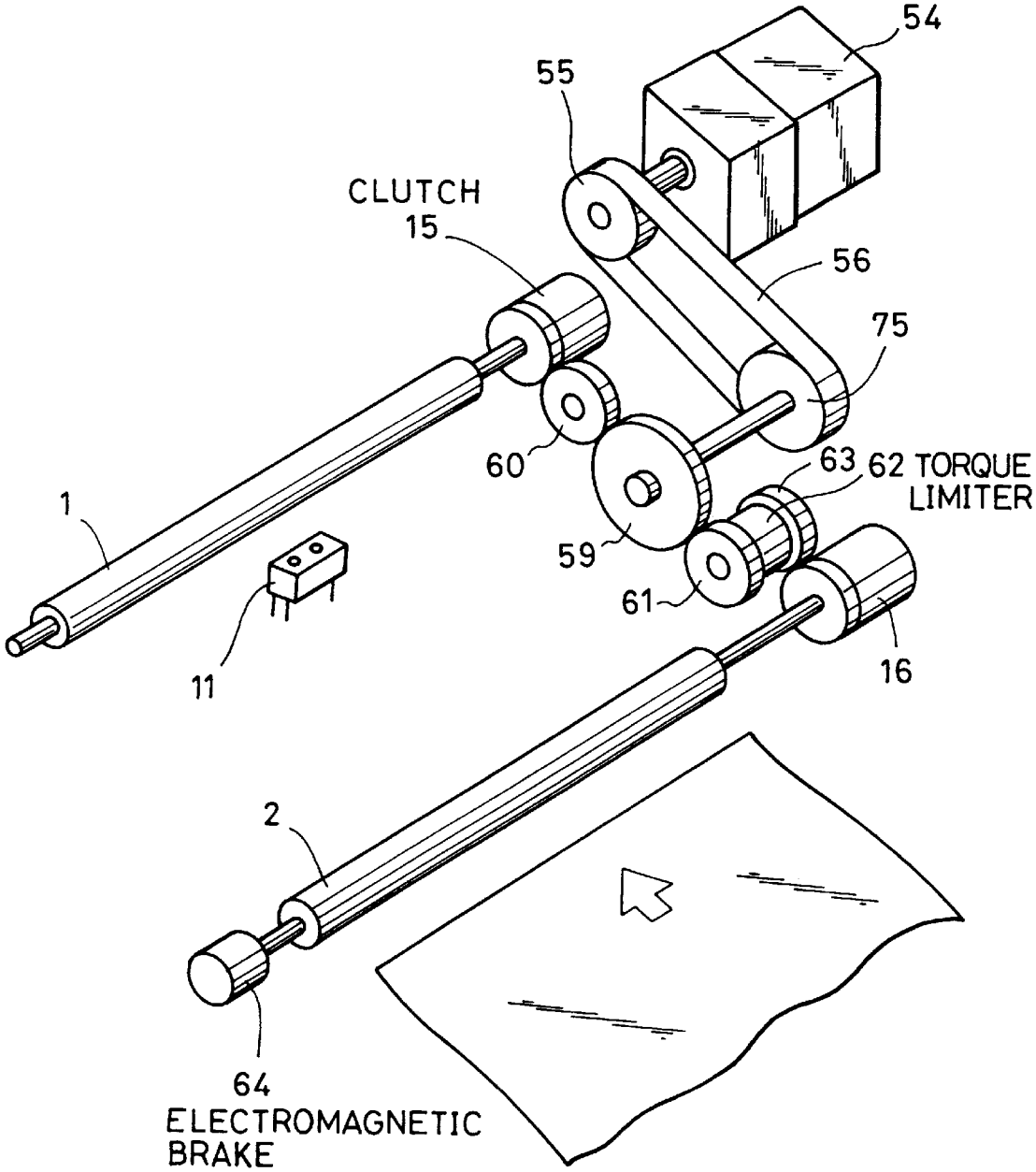
FIG. 9 is a perspective view of the essential portion in accordance with a fourth embodiment of the present invention.

FIG. 9 is a perspective view of the essential portion illustrating drive means of first and second register rollers in which the present invention is applied to an electrophotographic copying machine.

Since the construction of the essential portion of the image formation inside the electrophotographic copying machine in the fourth embodiment is the same as that described in the first embodiment, an explanation thereof is omitted.

The first register roller 1 and the second register roller 2 are connected from a motor 54 through a drive train, and rotation driving is transmitted via clutches 15 and 16, respectively.

Reference numeral 55 denotes a timing pulley mounted on the output shaft of a motor 54. Reference numeral 56 denotes a timing belt. Reference numeral 57 denotes a timing pulley. Reference numeral 58 denotes a terminal shaft on which the timing pulley 57 is securedly provided. A gear 59 is securedly provided in the other end of the terminal shaft 58. Reference numeral 60 denotes a idler gear which meshes with the gear 59 and the gear of the clutch 15 and transmits driving. Reference numeral 61 denotes a gear. Reference numeral 62 denotes a torque limiter. Reference numeral 63 denotes a gear.

The gear 61 meshes with the gear 59 and receives driving. A torque smaller than a predetermined torque (the set torque of the torque limiter 62) is transmitted from the gear 61 to the gear 63 via the torque limiter 62. The gear 63 also meshes with the gear of the clutch 16 and transmits driving.

An electromagnetic brake 64 is mounted in the other end of the second register roller 2, and the control board (not shown) makes it possible to provide a predetermined braking torque to the second register roller 2.

When a braking torque such as that which fluctuates the value of the set torque of the torque limiter 62 is generated in the electromagnetic brake 64, the second register roller 2 repeatedly rotates and stops microscopically. Therefore, as a result, the same effect as decreasing the speed of the rotation can be obtained macroscopically.

Figure 10:
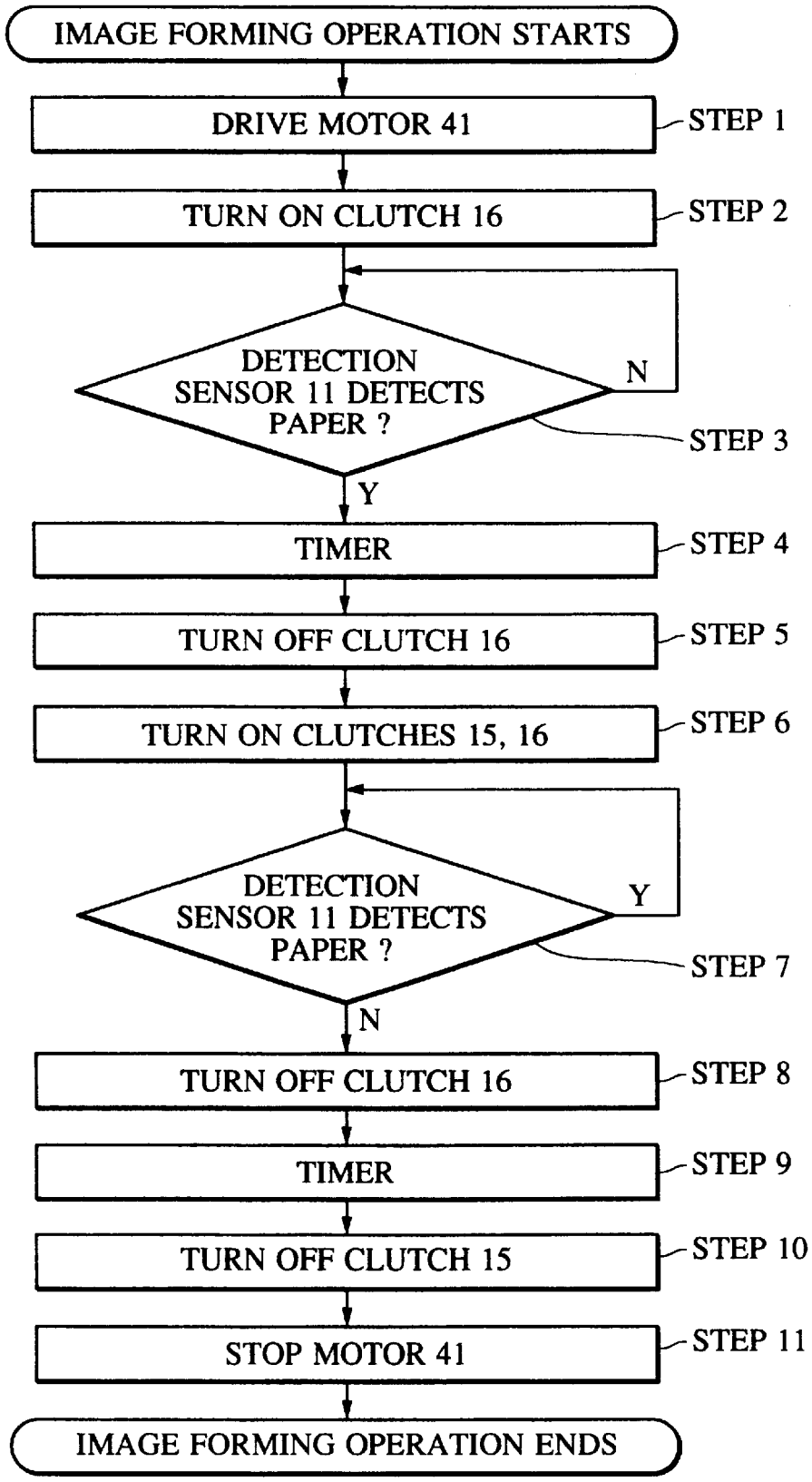
FIG. 10 is a flowchart illustrating control in accordance with the fourth embodiment of the present invention.

FIG. 10 is a flowchart illustrating control of the motor 54, the clutches 15 and 16, and the electromagnetic brake 64.

After the electrophotographic copying machine receives an image formation command, the motor 54 is driven (step 1). Then, the clutch 16 is turned on, and the second register roller 2 starts to rotate to transport the sheet member at the process speed V (step 2).

The sheet member which is fed one by one from the paper supply cassette reaches the second register roller 2 and is transported at speed V, and the top edge of the sheet member is detected by the detection sensor 11 (step 3). Thereupon, the electromagnetic brake 64 is turned on, and the second register roller 2 is controlled so as to transport the sheet member at a speed v slower than the preset speed V (step 4). The sheet member hits the nip of the first register roller 1, is continued to be transported at speed v by the second register roller 2, and begins to form a loop.

After a predetermined time has elapsed which is necessary from when the top edge of the sheet member is detected by the detection sensor 11 until a sufficient loop is formed (step 5), the clutch 16 is turned off, and the rotation of the second register roller 2 is stopped (step 6). Instantly, the electromagnetic brake 64 is turned off (step 7).

The clutches 15 and 16 are turned on in synchronization with the toner image formed on the photosensitive drum 3 (step 8). Since both the first register roller 1 and the second register roller 2 transport the sheet member at speed V, the sheet member is transported while the formed loop is maintained for some time. After the bottom edge of the sheet member passes the detection sensor 11 (step 9), the clutch 16 is turned off, and the rotation of the second register roller 2 is stopped (step 10).

When a time has elapsed which is necessary from when the bottom edge of the sheet member passes the detection sensor 11 until the bottom edge of the sheet member passes the first register roller 1 (step 11), the clutch 15 is turned off, and the rotation of the first register roller 1 is stopped (step 12). Then, the motor 54 is stopped (step 13), and the image forming operation terminates.

[Fifth Embodiment]

Figure 11:
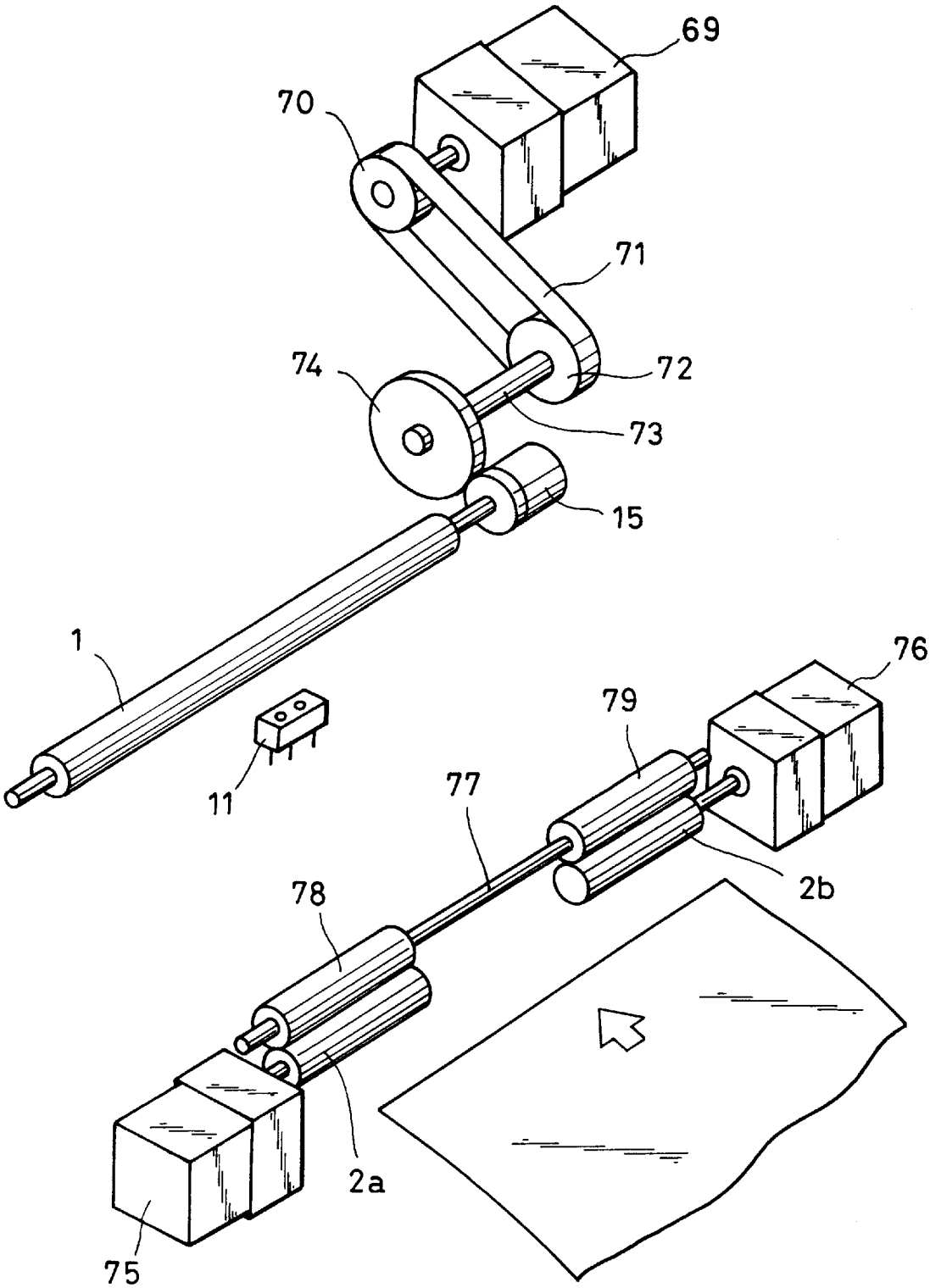
FIG. 11 is a perspective view of the essential portion in accordance with a fifth embodiment of the present invention.

FIG. 11 is a perspective view of the essential portion illustrating drive means of first and second register rollers in which the present invention is applied to an electrophotographic copying machine. Since the construction of the essential portion of the image formation inside the electrophotographic copying machine in the fifth embodiment is the same as that described in the first embodiment, an explanation thereof is omitted.

The first register roller 1 is connected from a motor 69 through a drive train, and is rotated via the clutch 15.

In the second register roller 2, a second left register roller 2*a* and a second right register roller 2*b* are provided independently of each other in both end portions along the width of the sheet member at right angles to the transport direction of the sheet member, and the second register rollers 2*a* and 2*b* are directly driven by motors 75 and 76, respectively.

Reference numeral 70 denotes a timing pulley. Reference numeral 71 denotes a timing belt. Reference numeral 72 denotes a timing pulley. Reference numeral 73 denotes a terminal shaft on which the timing pulley 72 is securedly provided. Reference numeral 74 denotes a gear which is securedly provided in the other end of the terminal shaft 73 and which meshes with the gear of the clutch 15. Reference numeral 77 denotes a shaft which is securedly provided in the main unit of the electrophotographic copying machine. Reference numerals 78 and 79 denote idler rollers which are capable of rotating on the shaft 77.

Reference numeral 2*a* denotes a second left register roller which is directly driven by the motor 75. Reference numeral 2*b* denotes a second right register roller which is directly driven by the motor 76. The second left register roller 2*a* and the idler roller 78, and the second right register roller 2*b* and the idler roller 79 are drivingly controlled in pairs independently of each other.

Figure 12A:
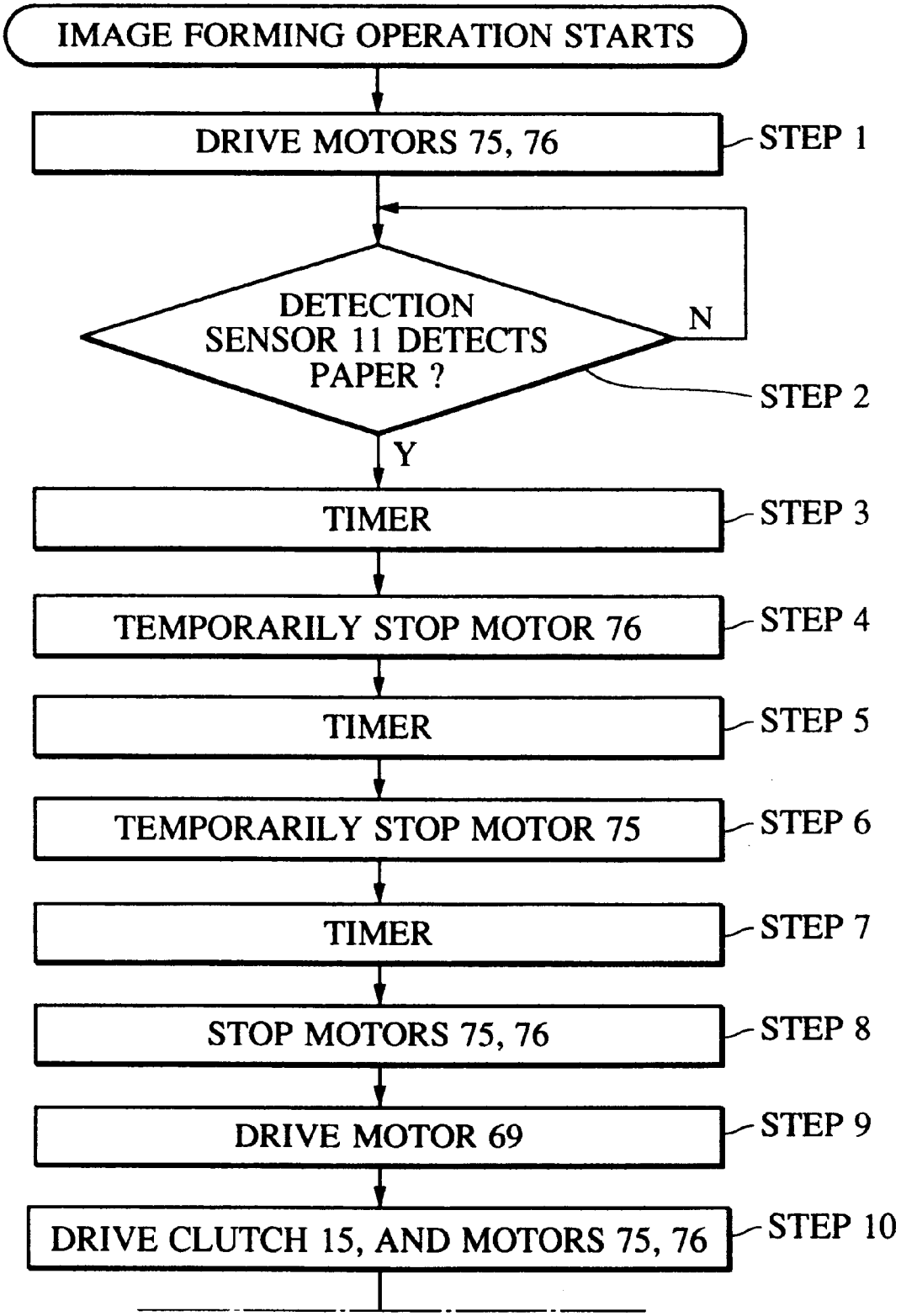
FIGS. 12, 12(A) and 12(B) are flowcharts illustrating control in accordance with the fifth embodiment of the present invention.
Figures 12, 12B:
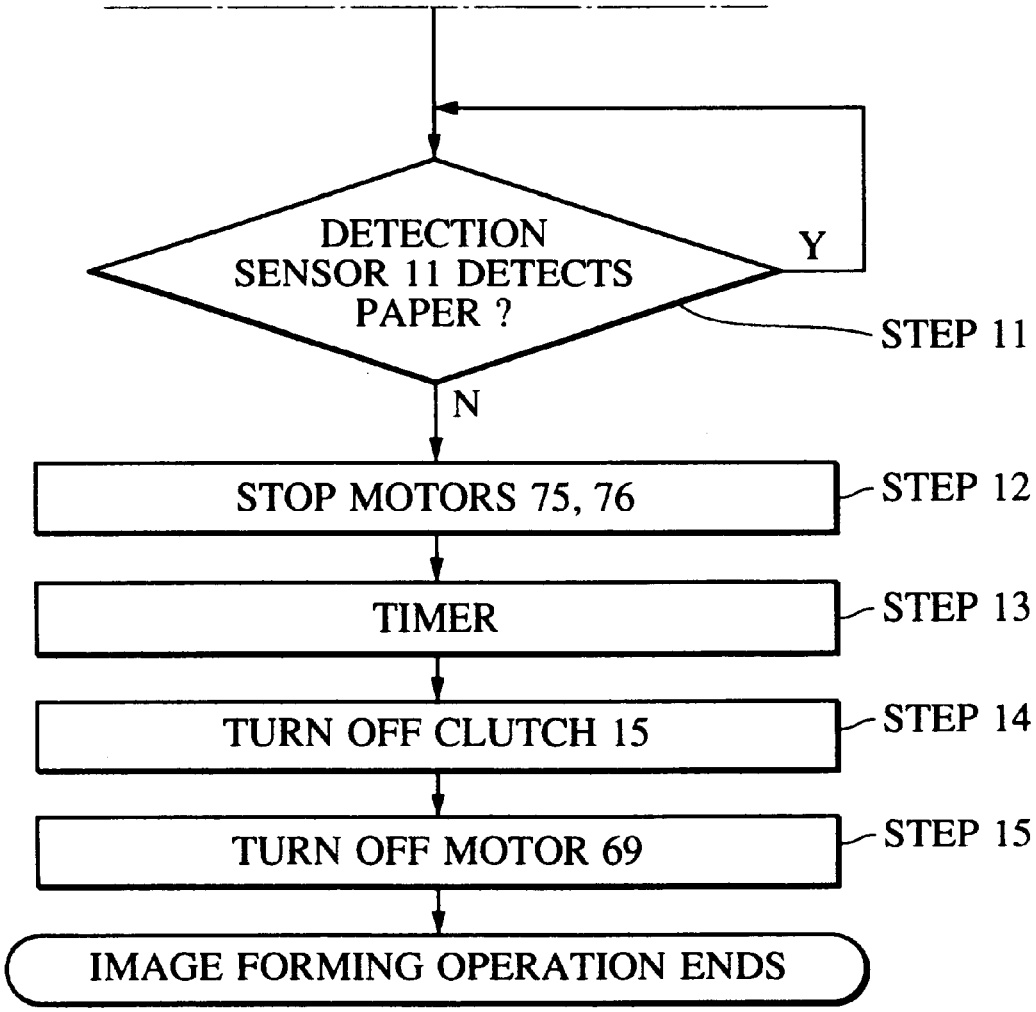
Figure 13A:
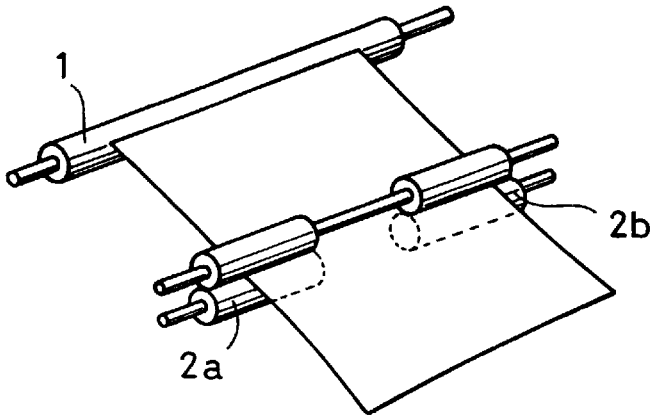
FIGS. 13(*a*) to 13(*d*) are perspective views of the essential portion illustrating operations in accordance with the fifth embodiment of the present invention.
Figure 13B:
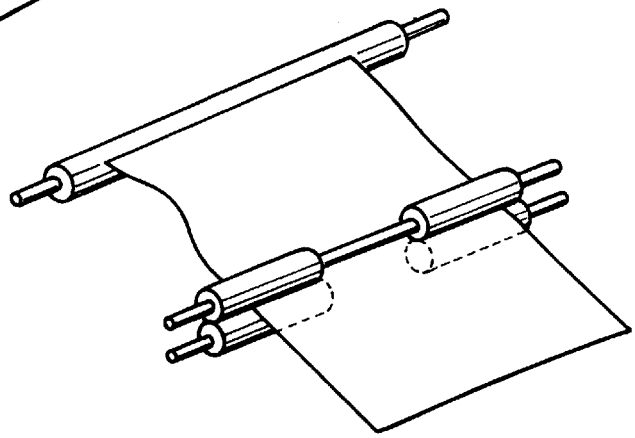
Figure 13C:
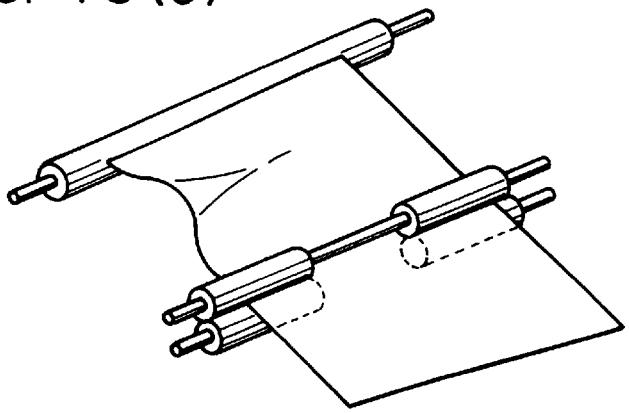
Figure 13D:
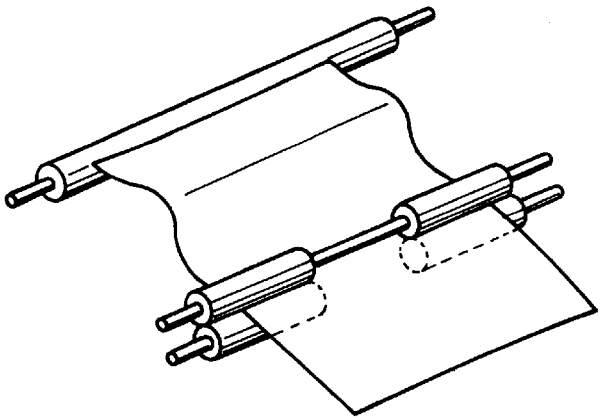

FIG. 12 is a flowchart illustrating control of the motor 69, the clutch 15, and the motors 75 and 76.

The motors 75 and 76 are driven after the electrophotographic copying machine receives an image formation command, and the second register rollers 2*a* and 2*b* begins to rotate to transport the sheet member at the process speed V (step 1).

The sheet member which is fed one by one from the paper supply cassette reaches the second register rollers 2*a* and 2*b* and is transported at speed V, and the top edge of the sheet member is detected by the detection sensor 11 (step 2). When the timer detects that a predetermined time has elapsed, the top edge of the sheet member reaches the nip of the first register roller 1 (step 3). At this time, after the driving of the motor 76 is stopped for a predetermined short time of t sec., the motor 76 is returned to its original driving state (step 4). Since the driving of the motor 76 is stopped temporarily, the transport of the right side of the sheet member in the direction of the movement thereof follows with a delay the transport of the left side of the sheet member, and therefore the loop is begun to be formed from the left side of the sheet member in the direction of the movement of the sheet member.

Then, when the timer detects that the predetermined time has elapsed (step 5), the driving of the motor 75 is stopped for t sec. and the motor 75 is returned to its original driving state (step 6). Since the driving of the motor 75 is temporarily stopped, the transport of the right side of the sheet member in the direction of the movement catches up with the left side, and the loop is formed from the left side of the sheet member in the direction of the movement thereof to the right side of the sheet member.

After the timer detects that the predetermined time has elapsed (step 7), the motors 75 and 76 are stopped, and the sheet member hits the first register roller 1 and forms a loop, and enters the wait state (step 8). Then, the motor 69 is driven (step 9).

The clutch 15, and the motors 75 and 76 are turned on in synchronization with the toner image formed on the photosensitive drum 3, the sheet member is transported again at speed V, the toner image is transferred onto the sheet member, and the image formation proceeds (step 10).

Thereafter, when the detection sensor 11 no longer detects the sheet member, that is, after the bottom edge of the sheet member passes the detection sensor 11 (step 11), the motors 75 and 76 are stopped, and the rotation of the second register rollers 2*a* and 2*b* is stopped (step 12).

When a time has elapsed which is necessary from when the bottom edge of the sheet member passes the detection sensor 11 until the bottom edge of the sheet member passes the first register roller 1 (step 13), the clutch 15 is turned off, and the rotation of the first register roller 1 is stopped (step 14). Then, the motor 69 is stopped (step 15), and the image forming operation terminates.

FIGS. 13(*a*) to 13(*d*) show the steps of forming the loop explained in the above-described steps 4 to 8.

FIG. 13(*a*) shows a state in which the sheet member hits the nip of the first register roller 1 in step 4.

FIG. 13(*b*) shows a state in which the loop is begun to be formed from the left side of the sheet member because the transport of the right side of the sheet member in the direction of the movement is delayed in step 5.

FIG. 13(*c*) shows a state in which the transport of the right side of the sheet member is catching up with the transport of the left side, and the loop is being formed toward the right side in step 6.

FIG. 13(*d*) shows a state in which the loop is uniformly formed along the width of the sheet member in step 7.

In the above-described first embodiment, since the distance from the sheet member housing section, such as a cassette or a deck, to the first register roller 1 is long, when it is desired to shorten the transport time, the motor 14 may be driven at speed K×H (K>1) which is faster than speed H in step 1 of the flowchart in FIG. 3. Then, the sheet member is transported at speed VH which is faster than the process speed V.

As has been described up to this point, according to the first aspect of the present invention, by changing the sheet member transport speed, to be specific, by using a variable speed controlled motor as the source for driving the sheet member, the sheet member transport speed when the sheet member hits the first register roller 1 and forms a loop is set at speed v slower than the process speed V. Since the loop is formed at a relatively low speed, it becomes possible to limit an impact sound when the sheet member buckles and forms a loop to be small, and contributes to reduced noise of the entire apparatus.

According to the second aspect of the present invention, a variable speed controlled motor is dedicatedly provided as the source for driving the sheet member transport means for making the sheet member form a loop, and driving control is performed independently of another sheet member transport driving control, and the sheet member transport speed when the loop is formed can be easily set at speed v slower than the process speed V. Since the loop is formed at a relatively low speed, it becomes possible to limit an impact sound when the sheet member buckles and forms a loop to be small, and contributes to reduced noise of the entire apparatus.

According to the third aspect of the present invention, the sheet member transport speed of the sheet member transport means for making the sheet member form a loop is set at speed v slower than the process speed V, and a mechanism for freeing the torque of a one-way clutch or the like is provided in the middle of the driving transmission passage.

Since the loop is formed at a relatively low speed, it becomes possible to limit an impact sound when the sheet member buckles and forms a loop to be small, and contributes to reduced noise of the entire apparatus.

According to the fourth aspect of the present invention, a torque limiter is provided in the middle of the driving transmission passage of the sheet member transport means for making the sheet member form a loop, and means for braking the transmission of the sheet member transport means is provided to decrease the sheet member transport speed of the sheet member transport means. Since the loop is formed at a relatively low speed, it becomes possible to limit an impact sound when the sheet member buckles and forms a loop to be small, and contributes to reduced noise of the entire apparatus.

According to the fifth aspect of the present invention, a loop is not formed at a stroke along the width of the sheet member at right angles to the transport direction of the sheet member. More specifically, sheet member transport means are provided independently of each other on the right and left sides in the direction of the transport of the sheet member so that a loop is begun to be formed from the end of one side of the sheet member and the loop is formed successively toward the the other end.

Since the loop is not formed at a stroke and formed in succession, it becomes possible to almost limit the generation of an impact sound when the sheet member buckles, and contributes to reduced noise of the entire apparatus.

Many different embodiments of the present invention may be constructed without departing from the spirit and scope of the present invention. It should be understood that the present invention is not limited to the specific embodiments described in this specification. To the contrary, the present invention is intended to cover various modifications and equivalent arrangements included within the spirit and scope of the invention as hereafter claimed. The scope of the following claims is to be accorded the broadest interpretation so as to encompass all such modifications, equivalent structures and functions.

What is claimed is:

1. An image forming apparatus comprising:

first transport means for transporting a sheet member;

second transport means disposed upstream of said first transport means for transporting a sheet member to said first transport means;

a motor operable at a rotational speed;

a first clutch for transmitting the drive force of said motor to said first transport means;

a second clutch for transmitting the drive force of said motor to said second transport means;

control means for controlling said motor, said first clutch and said second clutch in such a way that the rotational speed of said motor changes while said first clutch is disengaged and said second clutch is engaged, thereby changing the transport speed of said second transport means from a speed faster than that of said first transport means to a speed slower than that of said first transport means before said sheet member hits said first transport means, and the end portion of said sheet member hits said first transport means at rest so that the sheet member forms a loop; and image forming means for forming an image on a sheet member transported by said first transport means.

2. A sheet transport apparatus comprising:

first transport means for transporting a sheet with the sheet being nipped;

second transport means for transporting a sheet to said first transporting means;

a motor;

a first clutch for transmitting the drive force of said motor to said first transport means;

a second clutch for transmitting the drive force of said motor to said second transport means;

control means for controlling said motor, said first clutch and said second clutch in such a way that said motor rotates at a first rotational speed while said first clutch is disengaged and said second clutch is engaged, and then the rotational speed of said motor changes to a second rotational speed, so that a sheet is transported at a first transport speed by said second transport means, and the sheet transport speed by said second transport means is changed to a second transport speed slower than said first transport speed before the leading edge of the sheet reaches said first transport means, and then the leading edge of the sheet is made to hit said first transport means at rest, and further the sheet is transported at the second transport means so that the sheet forms a loop between said first and said second transport means.

3. A sheet transport apparatus according to claim 2, further comprising: detecting means for detecting a sheet, said control means causing the transport speed of said second transport means to change from the first transport speed to the second transport speed on the basis of the detection of a sheet by said detecting means.

4. A sheet transport apparatus according to claim 2, wherein after the sheet forms the loop, the first transport means transports the sheet at a third transport speed faster than the second transport speed.

5. A sheet member transport apparatus according to claim 4, further comprising: image forming means for forming an image on a sheet transported at the third transport speed.

6. A sheet transport apparatus according to claim 4, wherein the first transport speed is faster than the third transport speed.

7. A sheet transport apparatus according to claim 4, wherein the first transport speed is substantially equal to the third transport speed.

8. An image forming apparatus according to claim 1, wherein the change in the transport speed of said second transport means occurs from a first transport speed to a second transport speed, and after the sheet member forms the loop, said first transport means transports the sheet member at a third transport speed faster than the second transport speed.

9. An image forming apparatus according to claim 8, wherein the first transport speed is faster than the third transport speed.

10. An image forming apparatus according to claim 9, wherein said image forming means forms an image on the sheet member transported at the third transport speed.

11. An image forming apparatus according to claim 8, wherein the first transport speed is substantially equal to the third transport speed.

12. An image forming apparatus according to claim 11, wherein said image forming means forms an image on the sheet member transported at the third transport speed.

13. An image forming apparatus according to claim 8, further comprising: detecting means for detecting a sheet member and said control means changing the rotational speed of said motor so that the transport speed of said second transport means changes from the first transport speed to the second transport speed on the basis of the detection of a sheet member by said detecting means.

14. A sheet transport apparatus comprising:

first transport means for transporting a sheet with the sheet being nipped;

second transport means for transporting a sheet to said first transporting means;

a motor;

first transmitting means for transmitting the drive force of said motor to said first transport means through a first clutch;

second transmitting means for transmitting the drive force of said motor to said second transport means through a second clutch;

a control means for controlling said motor, said first clutch and said second clutch in such a way that said motor rotates at a first rotational speed while said first clutch is off and said second clutch is on, and then the rotational speed of said motor changes to a second rotational speed, so that a sheet is transported at a first transport speed by said second transport means, the sheet transport speed slower than said first transport speed before the leading edge of the sheet reaches said first transport means, and then the leading edge of the sheet is made to hit said first transport means, and further the sheet is transported at the second transport means so that the sheet forms a loop between said first and second transport means, and after the sheet forms the loop, the first transport means transports the sheet at a third transport speed faster than the second transport speed;

wherein said first transport speed is faster than said third transport speed.

15. A sheet transport apparatus according to claim 14, further comprising an image forming means for forming an image on a sheet transported at the third transported speed.

16. A sheet transport apparatus according to claim 14, further comprising: detecting means for detecting a sheet member, wherein said control means changes the rotational speed of said motor so that the transport speed of said second transport means changes from the first transport speed to the second transport speed on the basis of the detection of a sheet member by said detecting means.

* * * * *

UNITED STATES PATENT AND TRADEMARK OFFICE

CERTIFICATE OF CORRECTION

PATENT NO. : 6,092,803

DATED : July 25, 2000

INVENTOR(S): KATSUMI MUNENAKA

It is certified that error appears in the above-identified patent and that said Letters Patent is hereby corrected as shown below:

COLUMN 12:
Line 7, "VH" should read --$V_{1-1}$.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*